US009717937B2

(12) United States Patent
Miller et al.

(10) Patent No.: US 9,717,937 B2
(45) Date of Patent: Aug. 1, 2017

(54) SPRINKLER DEFLECTOR

(71) Applicant: Tyco Fire Products LP, Lansdale, PA (US)

(72) Inventors: Lyle Miller, Framingham, MA (US); Mathew R. Ancone, Warwick, RI (US)

(73) Assignee: Tyco Fire Products LP, Lansdale, PA (US)

( * ) Notice: Subject to any disclaimer, the term of this patent is extended or adjusted under 35 U.S.C. 154(b) by 252 days.

(21) Appl. No.: 14/430,152

(22) PCT Filed: Sep. 20, 2013

(86) PCT No.: PCT/US2013/061017

§ 371 (c)(1),
(2) Date: Mar. 20, 2015

(87) PCT Pub. No.: WO2014/047499

PCT Pub. Date: Mar. 27, 2014

(65) Prior Publication Data

US 2015/0246253 A1 Sep. 3, 2015

Related U.S. Application Data

(60) Provisional application No. 61/704,430, filed on Sep. 21, 2012, provisional application No. 61/724,843, filed on Nov. 9, 2012.

(51) Int. Cl.
*A62C 35/68* (2006.01)
*A62C 37/11* (2006.01)
(Continued)

(52) U.S. Cl.
CPC ..... *A62C 35/68* (2013.01); *A62C 31/02* (2013.01); *A62C 37/11* (2013.01); *B05B 1/265* (2013.01); *B05B 1/267* (2013.01)

(58) Field of Classification Search
CPC ..... A62C 35/68; A62C 37/11–37/16; A62C 31/02; B05B 1/262–1/267
(Continued)

(56) References Cited

U.S. PATENT DOCUMENTS 5,609,211 A 3/1997 Meyer et al.
5,865,256 A * 2/1999 Pounder ..... A62C 37/14 169/37
(Continued)

OTHER PUBLICATIONS

International Search Report and Written Opinion dated Aug. 5, 2014, International Application No. PCT/US2013/061017 filed on Sep. 20, 2013, 21 pages.
(Continued)

*Primary Examiner* — Arthur O Hall
*Assistant Examiner* — Cody Lieuwen
(74) *Attorney, Agent, or Firm* — Perkins Coie LLP

(57) ABSTRACT

A sprinkler assembly including a fluid deflecting structure including a plurality of spaced apart tines defining a plurality of slots. The tines include a first pair of symmetric tines and a second pair of symmetric tines disposed orthogonally to the first pair of symmetric tines. The plurality of slots includes a group of asymmetric slots each having a first portion with a constant width and a second portion with a variable width radially outward of the first portion of the asymmetric slot.

24 Claims, 5 Drawing Sheets

(51) Int. Cl.
*A62C 31/02* (2006.01)
*B05B 1/26* (2006.01)

(58) Field of Classification Search
USPC ..... 239/498, 504, 518, 524; 169/37–41, 90
See application file for complete search history.

(56) References Cited

U.S. PATENT DOCUMENTS

| | | | | |
|---|---|---|---|---|
| 8,353,356 | B2 | 1/2013 | Rogers | |
| 9,457,213 | B2 | 10/2016 | Miller et al. | |
| 2007/0114047 | A1* | 5/2007 | Fischer | A62C 31/02 169/37 |
| 2008/0011491 | A1* | 1/2008 | Thau | A62C 31/02 169/37 |
| 2009/0078432 | A1* | 3/2009 | Tow | A62C 37/14 169/37 |
| 2010/0276164 | A1* | 11/2010 | Feenstra | A62C 37/11 169/37 |
| 2011/0036598 | A1 | 2/2011 | Pahila | |

OTHER PUBLICATIONS

IFW, U.S. Appl. No. 61/704,430, filed Sep. 21, 2012, 284 pages.
IFW, U.S. Appl. No. 61/724,843, filed Nov. 19, 2012, 279 pages.
IFW, European Patent Applicaiton No. 13771719.1, filed on Sep. 20, 2013, 654 pages.
NFPA 13, Standard for the Installation of Sprinkler Systems, 2010 Edition, 22 pages.
FM Approvals, Approval Standard for Suppression Mode, [Early Suppression—Fast Response (ESFR)] Automatic Sprinklers, Oct. 2006, 88 pages.
UL1767 ESFR Sprinklers, Sep. 2010, 5 pages.

* cited by examiner

SPRINKLER DEFLECTOR

PRIORITY CLAIM & INCORPORATION BY REFERENCE

This application is a 35 U.S.C. §371 application of International Application No. PCT/US2013/061017 filed Sep. 20, 2013, which claims the benefit of priority to U.S. Provisional Patent Application No. 61/704,430, filed Sep. 21, 2012 and U.S. Provisional Patent Application No. 61/724,843, filed Nov. 9, 2012, each of which is incorporated by reference in its entirety.

BACKGROUND OF THE INVENTION

Automatic sprinkler systems are some of the most widely used devices for fire protection. These systems have sprinklers that are activated once the ambient temperature in an environment, such as a room or building exceeds a predetermined value. Once activated, the sprinklers distribute fire-extinguishing fluid, preferably water, in the room or building. A sprinkler system is considered effective if it extinguishes or prevents growth of a fire. The effectiveness of a sprinkler is dependent upon the sprinkler consistently delivering an expected flow rate of fluid from its outlet for a given pressure at its inlet.

An automatic sprinkler may be configured for addressing a fire in a particular mode such as for example, control mode or suppression mode. One form of suppression mode is Early Suppression Fast Response (ESFR) which is defined under industry accepted standards, such as for example, the National Fire Protection Association (NFPA) standard entitled, "NFPA 13: Standards for the Installation of Sprinkler Systems" (2013 ed.) ("NFPA 13"), Section 3.6.4.2 as a sprinkler having a thermal sensitivity, i.e., response time index ("RTI") of 50 meter$^{1/2}$ second$^{1/2}$ ("m$^{1/2}$ sec$^{1/2}$") or less and "listed" for its capability to provide fire suppression of specific high-challenge fire challenges. A "listed" sprinkler for fire suppression is a sprinkler that has been tested, verified and published in a list by an industry accepted organization, such as for example, FM Global ("FM") and Underwriters Laboratories ("UL") as a sprinkler being suitable for the specified purpose of fire suppression. Fire suppression is defined by NFPA 13, Section 3.3.12 as "[s]harply reducing the heat release rate of a fire and preventing its regrowth by means of direct and sufficient application of water through the fire plume to the burning fuel surface." UL and/or FM test and verify fire suppression performance of a sprinkler by at least installing and subjecting the sprinkler to their respective water distribution test standards: (i) FM Approval Standard Class No. 2008 (2006), which is attached to U.S. Patent Application No. 61/724,843; and (ii) UL Standard for Early-Suppression Fast-Response Sprinklers UL 1767 (2010), which is attached to U.S. Patent Application No. 61/724,843.

The ESFR test standards and requirements for suppression are generally related to the K-factor of the sprinkler. The discharge coefficient or K-factor of a sprinkler allows for an approximation of flow rate to be expected from an outlet of a sprinkler based on the square root of the pressure of fluid fed into the inlet of the sprinkler. As used herein, the K-factor is defined as a constant representing the sprinkler discharge coefficient that is quantified by the flow of fluid in gallons per minute (GPM) from the sprinkler outlet divided by the square root of the pressure of the flow of fluid fed into the inlet of the sprinkler passageway in pounds per square inch (PSI). The K-factor is expressed as GPM/(PSI)$^{1/2}$.

NFPA 13 provides for a rated or nominal K-factor or rated discharge coefficient of a sprinkler as a mean value over a K-factor range. Chapters 3, 12 and Sec. 6.2-6.5 of Chapter 6 of the 2010 edition of NFPA 13 are attached to U.S. Patent Application No. 61/724,843. For example, for a K-factor greater than 11, NFPA 13 provides the following nominal K-factors (with the K-factor range shown in parenthesis): (i) 14.0 (13.5-14.5) GPM/(PSI)$^{1/2}$; (ii) 16.8 (16.0-17.6) GPM/(PSI)$^{1/2}$; (iii) 19.6 (18.6-20.6) GPM/(PSI)$^{1/2}$; (iv) 22.4 (21.3-23.5) GPM/(PSI)$^{1/2}$; (v) 25.2 (23.9-26.5) GPM/(PSI)$^{1/2}$; and (vi) 28.0 (26.6-29.4) GPM/(PSI)$^{1/2}$. For purposes herein, suppression performance can be determined for sprinklers having K-factors not listed in the test standards by an appropriate equivalent requirement extrapolated from the available test standards. Moreover, suppression performance may be determined by other criteria in addition to or alternatively to the ESFR test standards, such as for example, by the hydraulic design criteria of the sprinkler and more specifically the hose stream demand criteria.

While ESFR sprinklers are defined by the RTI of the sprinkler and its performance under the test standards, it should be understood that "suppression" mode sprinklers are not necessarily limited to ESFR sprinklers or sprinklers having an RTI of 50 or less. Accordingly, suppression mode sprinklers satisfying standardized test and/or other suppression criteria may have a thermally sensitive trigger having an RTI of fast or standard response sprinklers, i.e., RTI of 50 or greater.

DISCLOSURE OF THE INVENTION

The present invention is directed to a preferred sprinkler assembly including a preferred fluid deflecting structure. In one particular embodiment, a preferred sprinkler includes a sprinkler frame having a body including an inlet, an outlet and an internal passageway extending between the inlet and the outlet to define a longitudinal sprinkler axis. The frame preferably includes two frame arms extending distally from the body about the outlet to define a plane bisecting the body such that the arms are equidistantly disposed about the plane. A planar fluid deflecting structure is preferably supported by the frame arms having its center centrally aligned along the longitudinal sprinkler axis with a peripheral edge disposed about the center. In one preferred embodiment, the deflecting structure preferably includes a first peripheral edge defining a first diameter of the deflecting structure about the center and a second peripheral edge defining a second diameter of the deflecting structure about the center in which the second diameter is greater than the first diameter. The deflecting structure preferably includes a quadrant defined by a plurality of tines including: a first symmetrical tine defining a first axis of symmetry disposed in the plane; a second symmetrical tine defining a second axis of symmetry disposed orthogonally with respect to the first axis of symmetry; and an asymmetric slot radially disposed between the first and second symmetrical tine. The asymmetric slot preferably includes an open end at the peripheral edge, a closed end defining the radially innermost portion of the slot, and a pair of spaced apart sidewalls extending from the closed end to the peripheral edge, wherein a first sidewall defines a substantially constant angle with respect to the first and second axes of symmetry over the length of the asymmetric slot; and a second sidewall including a first segment defining a first angle with respect to the first and second axes of symmetry and at least a second segment defining a second angle different than the first angle with respect to the first and second axes of symmetry such that the asymmetric slot broadens in a direction from the closed end to the open end.

Another preferred embodiment of a sprinkler assembly includes a planar fluid deflecting structure having a plurality of tines including a first pair of symmetrical tines defining a first axis of symmetry disposed in the plane and a second pair of symmetrical tines defining a second axis of symmetry disposed orthogonally with respect to the first axis of symmetry. Each pair of symmetrical tines preferably includes a first portion having a constant width and a second portion radially outward of the first portion having a variable width such that the second portion broadens in the direction from the center to the peripheral edge of the deflecting structure. The second portion of the second pair of symmetrical tines preferably includes an outer edge having a first segment defining a first included angle with respect to the second axis of symmetry and a second segment defining a second included angle with respect to the second axis of symmetry that is less than the first angle. The preferred deflecting structure preferably includes two pairs of asymmetric tines angularly disposed between the first and second pairs of symmetric tines. The two pairs of asymmetric tines are radially adjacent to one another to define an asymmetric slot therebetween. The asymmetric slot preferably includes a first portion with a constant width and a second portion with a variable width radially outward of the first portion of the slot.

Another preferred embodiment of a sprinkler assembly includes a planar fluid deflecting structure including a plurality of spaced apart tines defining a plurality of slots. The tines preferably include a first pair of symmetrical tines defining a first axis of symmetry and a second pair of symmetrical tines defining a second axis of symmetry disposed orthogonally with respect to the first axis of symmetry. Each pair of symmetrical tines includes a first portion having a constant width and a second portion radially outward of the first portion having a variable width such that the second portion broadens in the direction from the center to the peripheral edge of the deflecting structure. Three groups of asymmetric slots are preferably radially disposed between the first and second pairs of symmetrical tines. The three groups of asymmetric slots preferably includes a first group of asymmetric slots having a first portion with a constant width and a second portion with a variable width radially outward of the first portion of the slot. The first group is radially disposed between a second and third group of asymmetric slots. Each of the second and third group of slots preferably has a first portion with a constant width and a second portion with a variable width radially inward of the first portion of the slot.

Another preferred embodiment of a sprinkler provides an Early Suppression Fast Response (ESFR) sprinkler that includes a frame having a body having an inlet, an outlet and an internal passageway extending between the inlet and the outlet to define a longitudinal sprinkler axis and a nominal K-factor of at least 14.0 GPM/(PSI)$^{1/2}$. A planar fluid deflecting structure is supported at a distance from the outlet of about 1¼ inches. The fluid deflecting structure includes a plurality of spaced apart tines defining a plurality of slots for distribution of water from the outlet which satisfies the ESFR water distribution requirements under Section 4.29 of FM Approval Standard Class No. 2008. In one preferred embodiment, the preferred fluid deflecting structure further includes a first peripheral edge defining a first diameter of the deflecting structure about its center and a second peripheral edge defining a second diameter of the deflecting structure about the center in which the second diameter is greater than the first diameter.

BRIEF DESCRIPTION OF THE DRAWINGS

The accompanying drawings, which are incorporated herein and constitute part of this specification, illustrate exemplary embodiments of the invention, and, together with the general description given above and the detailed description and attachments given below, serve to explain the features of the invention.

DETAILED DESCRIPTION OF THE PREFERRED EMBODIMENTS

Figure 1:
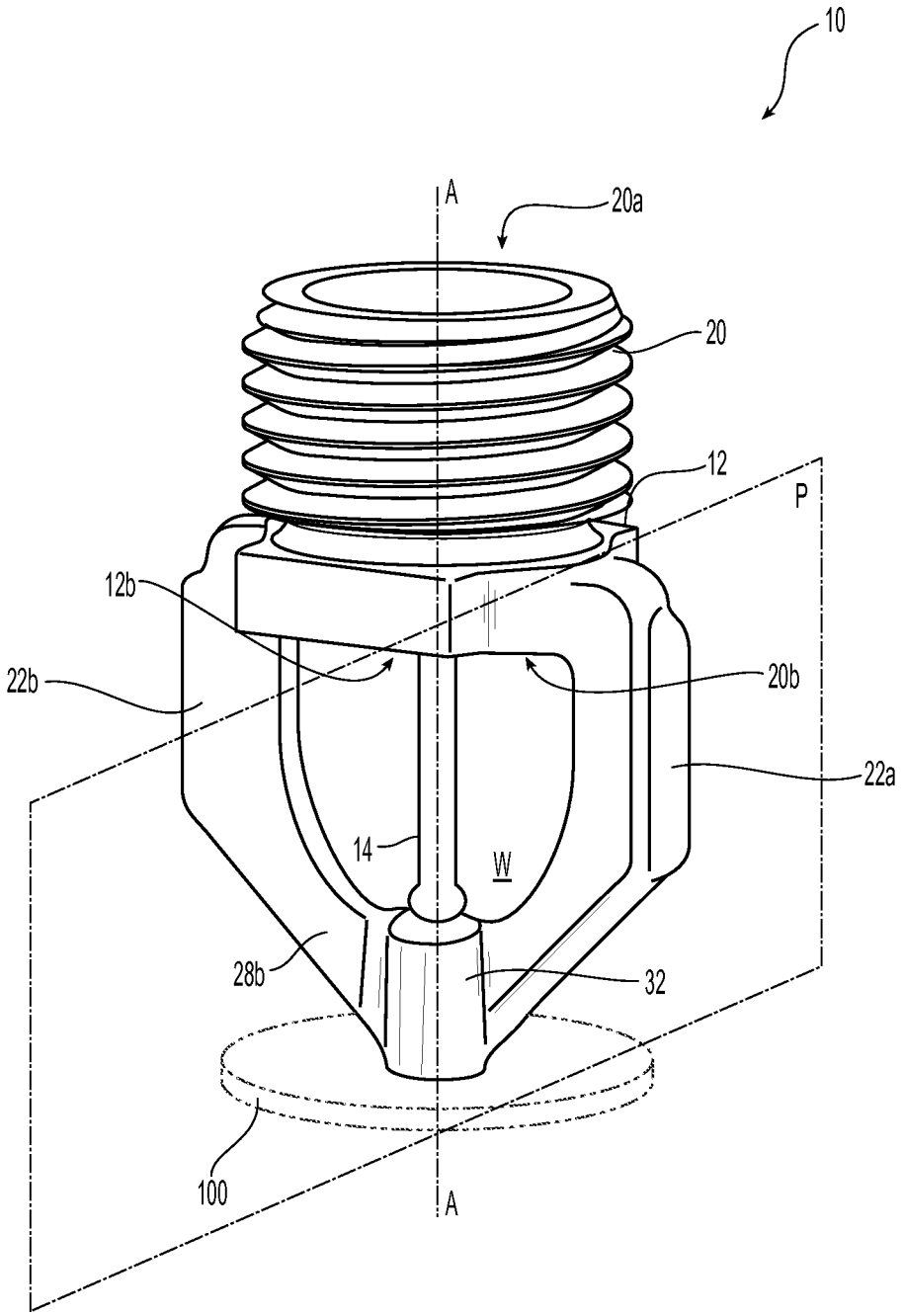
FIG. 1 is an isometric view of preferred embodiment of sprinkler assembly.

FIG. 1 illustrates a preferred embodiment of a sprinkler assembly 10 for installation in a fire protection piping network. The sprinkler assembly 10 includes a sprinkler frame 12, a fluid deflecting structure 100, and a thermal trigger 14 supporting a seal assembly (not shown) to seal the sprinkler in an unactuated configuration. The sprinkler frame 12 includes a body 20 having a proximal inlet 20*a*, a distal outlet 20*b*, and an internal passageway extending therebetween which defines a sprinkler axis A-A. As shown, the thermal trigger 14, is preferably a glass-bulb type trigger disposed and axially aligned along the sprinkler axis A-A for direct loading upon installation of the sprinkler in a fire protection system. Alternative trigger assemblies are possible, such as for example, an off-axis or a strut and lever thermally sensitive solder arrangement.

The sprinkler frame 12 includes one and more preferably two frame arms 22*a*, 22*b* that are radially positioned or diametrically opposed about the body 20 and its outlet 20*b*. The frame arms 22*a*, 22*b* preferably extends axially and distally toward the deflector 100 and preferably converge toward the sprinkler axis A-A to terminate at a terminal end of the frame 12 axially aligned along the sprinkler axis A-A and spaced from the sprinkler distal outlet 20*b*. The fluid deflecting structure 100 is preferably coupled to the distal terminal end of the frame 12 so as to depend or be supported from the frame arms 22*a*, 22*b* at a spaced distance from the distal outlet 20*b*. Fire fighting fluid, such as for example water discharged from the distal outlet 20*b*, impacts the deflecting structure 100 for distribution of the fluid in a desired spray pattern, for example, to satisfy one or more industry accepted performance standards as discussed in greater detail below. A preferred embodiment of the sprinkler assembly 10 provides for a pendent sprinkler configuration, and preferred embodiment of frame 12 is shown and described in U.S. Application No. 61/724,843 and in International PCT Application No. PCT/US2013/060997, filed Sep. 20, 2013, which is incorporated by reference in its entirety. As described, the frame arms 22, 22*b* of the sprinkler frame 12 preferably includes surface profiles which define a cross-sectional profile of the frame arm to facilitate the flow of heat toward the sprinkler axis A-A and the preferably axially disposed thermal trigger 14. One or more surfaces of the sprinkler frame arms can further define cross-sectional profiles of the frame arms and fluid deflecting surfaces which redirect fluid discharged from the distal outlet toward the fluid deflecting structure 100. For example, the converging portions of the sprinkler frame arms 22*a*, 22*b* may define a "tear drop" or airfoil cross-sectional profile with a taper in a direction toward the sprinkler axis A-A.

Figure 2:
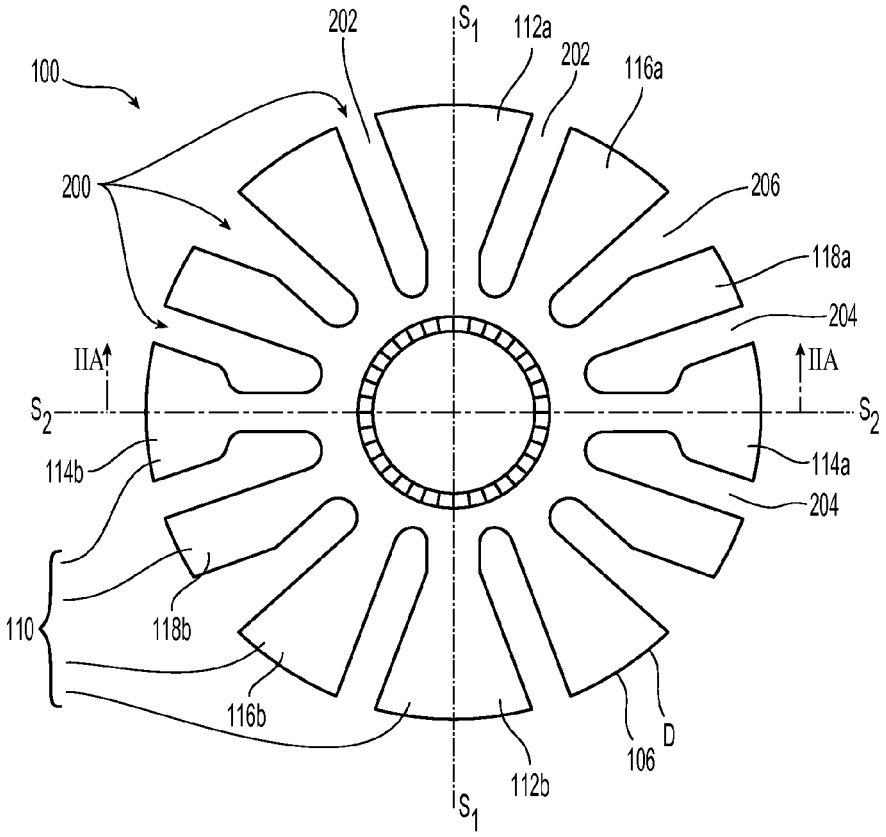
FIG. 2 is a plan view of a preferred deflector member for use in the assembly of FIG. 1.
Figure 2A:
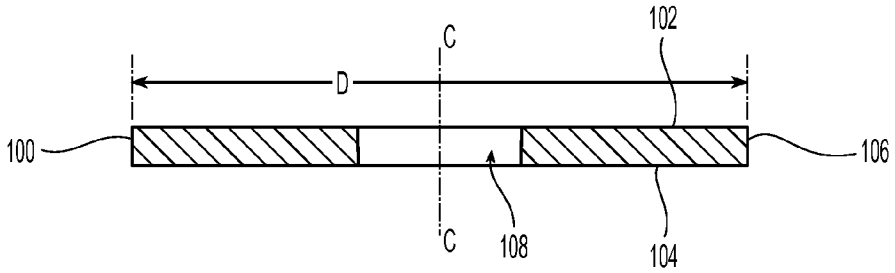
FIG. 2A is a cross-sectional view of the deflector member of FIG. 2 along line IIA-IIA.

Shown in FIGS. 2 and 2A is a preferred fluid deflecting structure 100. The fluid deflecting structure 100 includes a planar surface member 100 and more preferably a planar surface circular planar member 100 having a diameter D. In one preferred embodiment, the diameter D measures about 1¼ inch and is more preferably 1.27 inch. As used herein, the term "about" is understood as within a range of normal tolerance in the art, for example within 2 standard deviations of the mean. "About" can be understood as within 15%, 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about. The deflector member 100 has a first surface 102 and an opposite second surface 104 defining a thickness of the member 100 between the first and second surfaces 102, 104 with each of the first and second surface 102, 104 being preferably perpendicular to the sprinkler axis A-A. The thickness of the member 100 is preferably uniform over the member 100. As installed, the first surface 102 defines an upper surface of the deflector member 100 opposed to the outlet 20*b* of the frame 12. The deflector member 100 includes an outer peripheral edge 106 and a preferably circular mounting hole or closed form opening 108 for receiving and engaging the terminal end of the frame 12. The circular opening 108 defines a center C of the deflector 100 for central axial alignment along the sprinkler axis A-A.

Referring to FIG. 2, the deflector member 100 includes a plurality of spaced apart tines 110 which define or alternatively are defined by a plurality of slots 200 therebetween. The plurality of tines include a first pair of symmetrical tines 112*a*, 112*b* preferably diametrically opposed about the circular opening 108 and at least a second pair of symmetrical tines 114*a*, 114*b* preferably diametrically opposed about the circular opening 108. More particularly, the first pair of symmetrical tines 112*a*, 112*b* define a first axis of symmetry S1-S1 and the second pair of symmetrical tines 114*a*, 114*b* define a second axis of symmetry S2-S2 which extends perpendicularly with respect to the first axis of symmetry S1-S1. Disposed radially between the first and second symmetric tines 112, 114 are at least one and more preferably two asymmetric pairs of tines. As shown in FIG. 2, radially disposed between the first symmetric tine pairs 112*a*, 112*b* and the second symmetric tine pairs 114*a*, 114*b* are a first asymmetric tine pair 116*a*, 116*b* and a second asymmetric tine pair 118*a*, 118*b*.

Figure 2B:
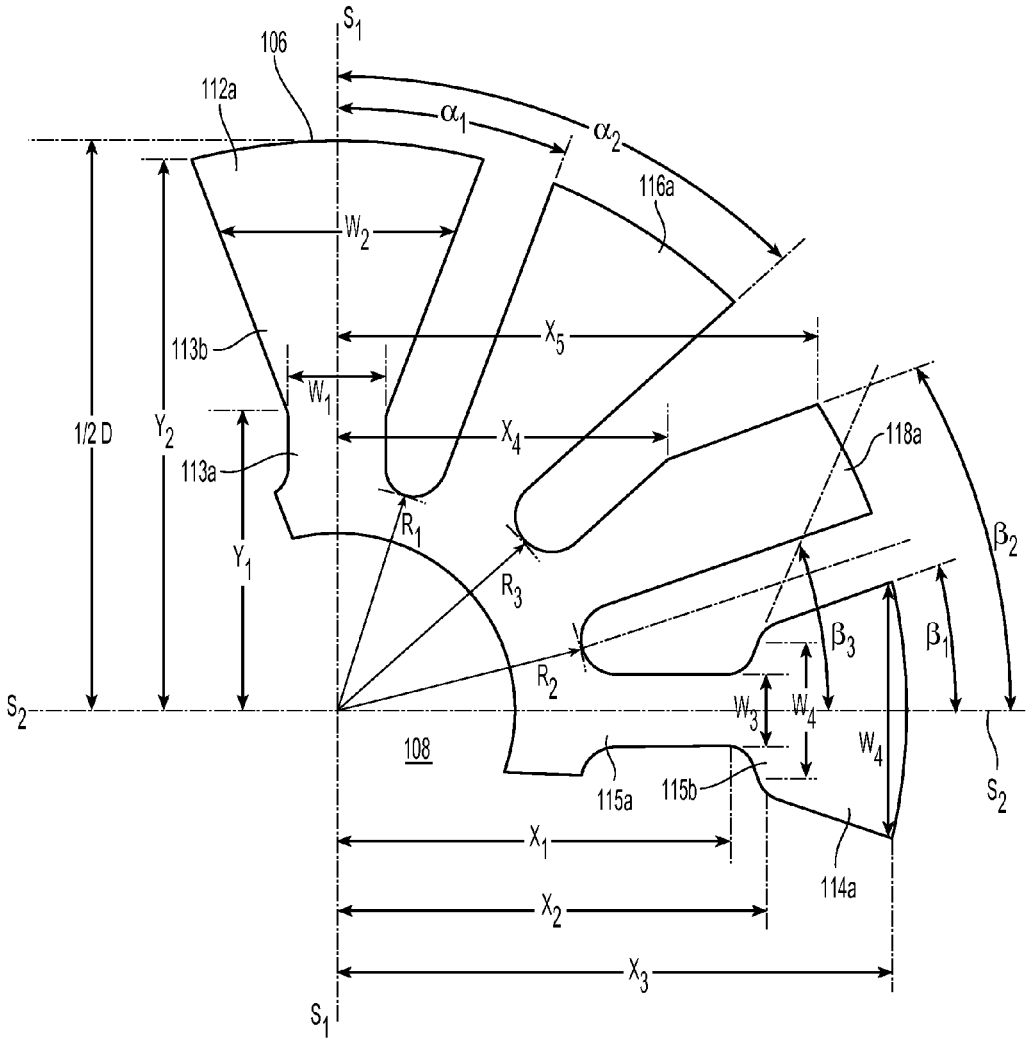
FIG. 2B is a detailed view of the deflector member of FIG. 2.

Each tine of the symmetrical pairs of tines preferably extends in the outward radial direction with a first portion of a constant width, and a second portion of a variable width. The widths of the tine are defined in a direction normal to the axis of symmetry. Referring to FIG. 2B, shown is first symmetrical tine 112*a* having a first radial inward portion 113*a* having a preferably constant width W1 and a second portion 113*b* between the peripheral edge 106 and the first portion 113*a* having a variable width W2. For the preferred 1.27 inch diameter deflector, the first portion 113*a* of the first symmetric tine 112*a* preferably extends from a first end located at a first distance y1, as measured from the second axis of symmetry S2-S2, to a second end located radially inward between the first end of the first portion 113*a* and the central opening 108. The constant first width W1 is preferably about 0.1 inch and the first distance y1 is about ⅓ inch and preferably about 0.325 inch.

The second width W2 of the portion 113*b* preferably broadens in the radial outward direction from the first portion 113*a* such that the second width w2 varies at a preferably constant rate so that the outer edges of the second portion 113*b* of the symmetrical tine 112*a* define a sidewall of a slot having a constant slope or included angle with respect to the axis of symmetry S1-S1, as described in greater detail below. At the peripheral edge 106, the outer edges of the second portion 113*b* preferably defines a distance y2 to the second axis of symmetry S2-S2 of about 0.6 inch and is more preferably about 0.614 inch. At its maximum, the second width W2 defines a width of about 0.32 inch to define a chord length of the tine 112*a*.

Second symmetrical tine 114*a* also preferably includes a first radial inward portion 115*a* having a preferably constant width W3 and a second portion 115*b* between the peripheral edge 106 and the first portion 115*a* having a variable width W4. The first portion 115*a* of the second symmetric tine 114*a* preferably extends from a first end located at a first distance X1, as measured from the first axis of symmetry S1-S1 to a second end radially inward and located between the first end of the first portion 115*a* and the central opening 108. For the preferred deflector member 100, the constant first width W3 is about 0.1 inch and preferably about 0.08 inch; and the first distance x1 is about 0.5 inch and preferably about 0.434 inch.

The second width W4 of the second portion 115*b* preferably broadens in the radial outward direction from the first portion 115*a* such that the second width W4 varies at a first preferably constant rate and then more preferably varies at a second preferably different constant rate to define a third variable width W4' so that the outer edges of the second portion 115*b* of the symmetrical tine 114*a* define a sidewall of a slot having first and second constant slopes or included angles with respect to the axis of symmetry S1-S1, as described in greater detail below. The outer edges of the preferred second portion 115*b* define a junction at the transition from the first rate of change in width to the second rate of change. The junction further defines a preferred distance x2 to the first axis of symmetry S1-S1 of about 0.5 inch. At the junction, the second width W4 defines a preferred width of about 0.14 inch. At the peripheral edge 106, the outer edges of the second portion 115*b* preferably define a distance X3 to the first axis of symmetry S1-S1 of about 0.6 inch and is more preferably about 0.62 inch. At its maximum, the third width W4' defines a width of about ⅓ inch and more preferably 0.28 inch to define a chord length of the tine 114*a*.

As noted above, the plurality of spaced apart tines 110 of the deflector 100 are defined by or alternatively define the slots 200 formed therebetween. Preferably radially disposed about the deflector center C-C, between orthogonally oriented first and second symmetric tines 112, 114, are at least three groups of asymmetric slots. Moreover, each of the asymmetric slots has a first portion with a constant width and a second portion having a variable width. The slot widths are measured normal to at least one sidewall defining the slot. In one preferred arrangement, an asymmetric slot having a first portion of a constant width radially inward of a second portion with a variable width is radially or angularly disposed between two slots having the constant width portion radially outward relative to its inner portion of a variable width.

Figure 2C:
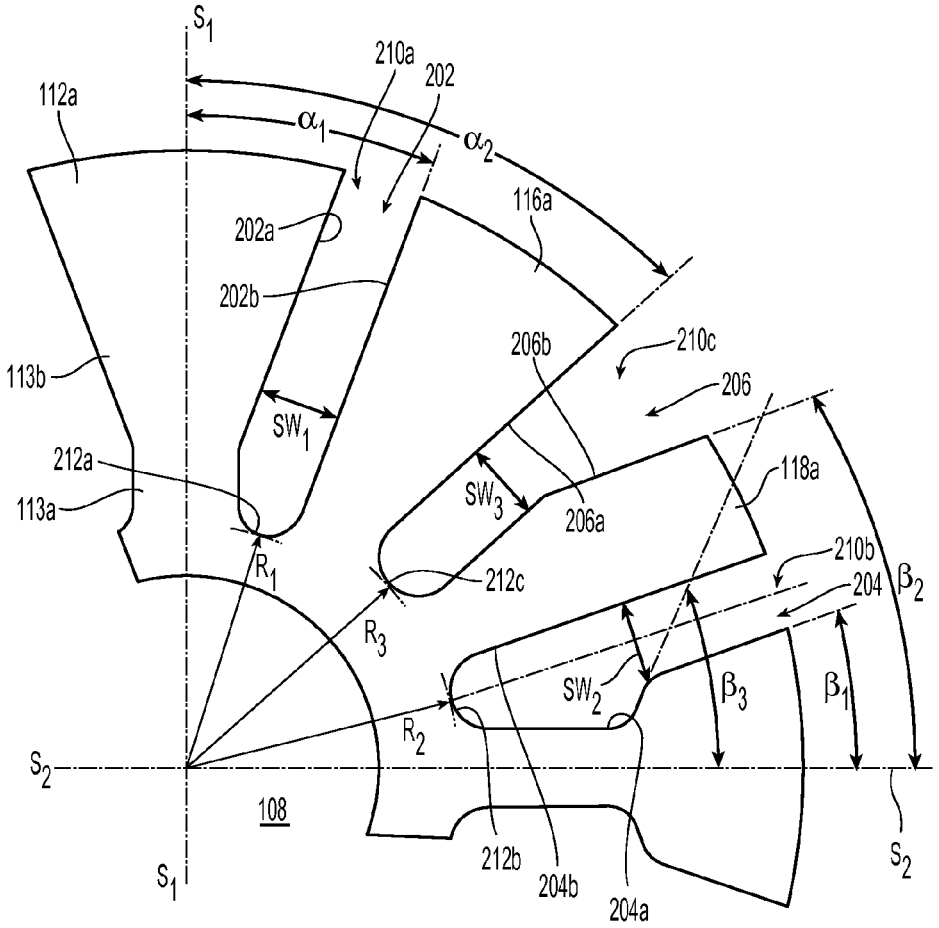
FIG. 2C is another detailed view of the deflector member of FIG. 2.

The preferred deflector member 100 includes three types of asymmetrical slot groups 202, 204, 206 radially disposed between the perpendicularly disposed symmetrical tines 112, 114. As shown in FIG. 2C, the slots 200 include open ended slots having a first open end 210 at the peripheral edge 106 and a second closed end 212 between the peripheral edge 106 and the central opening 108 of the deflector. It should be understood that the deflector may include one or more closed form slots provided the resulting deflector can provide the desired water distribution pattern, for example, as described herein. Each of closed ends of each slot preferably is defined by a radiused portion having one point which defines the radially innermost portion of the slot. More specifically, the radiused portion of the closed end preferably defines a tangent to a circle having its center aligned with the deflector center C to further define the radial distance R to the radially inner most portion of the slot 200. Extending between the open and closed ends 210, 212 are spaced apart sidewalls defined by the outer edge of radially adjacent tines. Depending on the profile of each radially adjacent tine and its outer edges, the sidewalls may converge, diverge or extend parallel with respect to one another to define the asymmetric slot 200 therebetween.

Referring to FIG. 2 of the preferred deflector 100, contiguously formed about the first symmetrical tines 112*a*, 112*b* is the first group of asymmetric slots 202; and contiguously formed about the second symmetrical tines 114*a*, 114*b* is the second group of asymmetric slots 204. Disposed between the first and second asymmetric slots 202, 204 are the third group of asymmetric slots 206. As shown in the detailed view of FIG. 2C, the first asymmetric slot 202 includes a slot open end 210*a* at the peripheral edge 106 of the deflector and a closed end 212*a* disposed radially inward of the open end 210*a*. The closed end 212*a* defines the radially innermost portion of the slot 202 disposed at a preferred radial distance R1 from the center C of the deflector 100 of about 0.25 inch. Extending between the open and closed ends 210*a*, 212*a* are the first sidewall 202*a* and second sidewall 202*b* of the asymmetric slot 202, which respectively correspond to the outer edges of symmetrical and asymmetrical tines 112*a*, 116*a*. The first and second sidewalls 202*a*, 202*b* are spaced apart and define one or more angles with respect to the axes of symmetry S1-S1, S2-S2 to define the profile of the asymmetric slot 202 and the slot width SW1 over the length of the slot. In the preferred embodiment of the asymmetric slot 202, the second sidewall 202*b* defines a substantially constant angle $\alpha$1 with respect to the first axis of symmetry S1-S1 over the length of the slot 202. The angle $\alpha$1 more preferably defines an angle of about twenty degrees and even more preferably about 21°. The first sidewall 202*a* preferably includes a first segment that extends substantially parallel to the second sidewall 202*b* and a second segment that extends substantially parallel to the first axis of symmetry S1-S1. The first segment preferably extends inwardly from the slot open end 210*a* preferably to the first end of the first portion 113*a* of the symmetric tine 112*a*. Accordingly for the preferred slot 202, the slot width SW1 is substantially constant for the first portion of the slot 202 defining a preferred width of about 0.8 inch. The constant width portion of the slot 202 is preferably radially outward with respect to the second portion of the slot in which the slot width SW1 varies.

As shown in FIG. 2, contiguously formed about the second symmetrical tines 114*a*, 114*b* is the second group of asymmetric slots 204. The second asymmetric slot 204 includes a slot open end 210*b* at the peripheral edge 106 and a closed end 212*b* disposed radially inward of the open end 210*b*. Referring again to FIG. 2C, the closed end 212*b* defines the radially innermost portion of the slot 204 disposed at a preferred radial distance R2 from the center C of the deflector 100 of about 0.3 inch and is more preferably about 0.28 inch. Extending between the open and closed ends 210*b*, 212*b* are the first sidewall 204*a* and second sidewall 204*b* of the asymmetric slot 204, which respectively correspond to the outer edges of symmetrical and asymmetrical tines 114*a*, 118*a*. The first and second walls 204*a*, 204*b* are spaced apart and define one or more angles with respect to the axes of symmetry to define the profile of the asymmetric second slot 204 and the slot width SW2 over the length of the slot. In the preferred embodiment of the asymmetric slot 204, the first sidewall 204*a* preferably includes: (i) a first segment that preferably extends radially outwardly from the closed end 212*b* parallel to the second axis of symmetry S2-S2; (ii) a second segment which preferably extends inwardly from the open end 210*b* to define a first included angle $\beta$1 with respect to the second axis of symmetry S2-S2; and (iii) at least a third segment preferably between the first and second segment which defines a second included angle $\beta$3 with respect to the second axis of symmetry different than the first included angle $\beta$1 and more preferably greater than the first angle $\beta$1. For the preferred deflecting member 100, the first angle $\beta$1 of the first sidewall is preferably about twenty degrees and even more preferably about 19°. The second angle $\beta$3 of the second segment of the first sidewall 204*a* is preferably about seventy degrees with respect to the second axis of symmetry and more preferably about 69°.

The second sidewall 204*b* of the second group of asymmetric slots 204 preferably extends from the open end 210*b* and parallel to the second segment of the first sidewall 204*a* to defines a substantially constant angle with respect to the second axis of symmetry S2-S2 over the length of the slot 204. Accordingly, the second sidewall 204*b* preferably defines an included angle with the second axis of symmetry S2-S2 to be about twenty degrees and even more preferably about 19°. For the preferred second asymmetric slot 204, the slot width SW2 is substantially constant for the first portion of the slot 204 defining a preferred width of about 0.08 inch. The constant width portion of the slot 204 is preferably radially outward with respect to the second portion of the slot having in which the slot width SW2 varies. More particularly for the preferred second asymmetric slot 204, the slot width SW2 is initially substantially constant over the second segment of the first sidewall 204*a* and then varies over the first and third segments of the first sidewall 204*a* radially inward of the second segment of the sidewall 204*a*.

Referring to FIG. 2, disposed between the first and second asymmetric slots 202, 204 is the third group of asymmetric slots 206 and contiguously formed with the asymmetric tines 116*a*, 118*a*. As shown in the detailed view of FIG. 2C, the third asymmetric slot 206 includes a slot open end 210*c* at the peripheral edge 106 and a closed end 212*c* disposed radially inward of the open end 210*c*. The closed end 212*c* defines the radially innermost portion of the slot 206 disposed at a preferred radial distance R3 from the center C of the deflector 100 of about 0.3 inch and is more preferably about 0.28 inch. Extending between the open and closed ends 210*c*, 212*c* are the first sidewall 206*a* and second sidewall 206*b* of the asymmetric slot 206, which respectively correspond to the outer edges of the asymmetrical tines 116*a*, 118*a*. The first and second sidewalls 206*a*, 206*b* are spaced apart and define one or more angles with respect to the axes of symmetry to define the profile of the asymmetric slot 206 and the slot width SW3 over the length of the slot. In the preferred embodiment of the asymmetric slot 206, the first sidewall 206*a* defines a substantially constant included angle α2 with respect to the first axis of symmetry S1-S1 over the length of the slot 206. The angle α2 more preferably defines an angle ranging between about forty-five to about fifty degrees (45°-50°) and even more preferably about 48° with respect to the first axis of symmetry S1-S1. The second sidewall 206*b* preferably includes a first segment that extends substantially parallel to the first sidewall 206*a* and a second segment that defines a third angle β2 to the second axis of symmetry S2-S2. The first segment preferably extends outwardly from the slot closed end 212*c* preferably to the second segment of the second sidewall 206*b*. The third angle β2 to the second axis of symmetry S2-S2 is preferably constant from the first segment to the peripheral edge 106 and defines a preferred included angle β2 of about twenty degrees. Accordingly for the preferred slot 206, the slot width SW3 is substantially constant for the first portion of the slot 206 defining a preferred width of about 0.08 inch. The constant width portion of the slot 206 is preferably radially inward with respect to the second portion of the slot in which the slot width SW3 varies.

More generally and with reference to FIGS. 2 and 2C, the subject deflector 100 provides an arrangement of tines and slots to provide for water distribution satisfying a desired sprinkler application, such as for example, suppression. Moreover, the deflector 100 provides for a quadrant of the deflector having a slot preferably disposed at about the 45 degree angle relative to the quadrant defining axes S1-S1, S2-S2. The subject slot is generally preferably defined by a first sidewall that is straight over the slot length to define a constant angle with respect to each of the deflector axes, S1-S1, S2-S2, and a second sidewall that varies over its length to define two or more angles with respect to the deflector axes and more preferably broaden the slot in the direction from the deflect to center to the peripheral edge.

For the preferred sprinkler assembly 10 shown in FIG. 1, the deflector member 100 may be mounted to the sprinkler frame 12 such that the first axis of symmetry S1-S1 is disposed in a plane P which bisects the frame 12 and more preferably is equidistantly disposed between the frame arms 22*a*, 22*b*. Accordingly, for the preferred sprinkler assembly 10, the first pair of symmetric tines 112*a*, 112*b* extend normal to the sprinkler frame window W defined by the frame arms 22*a*, 22*b*. Thus, for the preferred sprinkler assembly 10, the second axis of symmetry S2-S2 and second group of symmetric tines 114*a*, 114*b* are aligned orthogonally to the plane P and substantially in a direction toward the frame arms 22*a*, 22*b*.

The preferred sprinkler frame 12 further preferably defines a discharge coefficient with a nominal K-factor of about 14.0 GPM/$(PSI)^{1/2}$ and a preferred outlet-to-deflector distance of about 1¼ inch, and more particularly at an outlet-to-deflector distance of 1.27 inches. The combination of the preferred outlet-to-deflector distance and the preferred deflector diameter provides for an overall compact sprinkler assembly. The preferred sprinkler assembly 10 with the preferred deflector 100 has been tested for water distribution in accordance with the industry accepted standard, FM Approval Standard Class No. 2008 (October 2006). More specifically, the preferred sprinkler and deflector was installed and subjected to water distribution testing conforming with the FM sprinkler water distribution tests of Section 4.29 of FM Approval Standard Class No. 2008, entitled "Water Distribution (ESFR K14.0 and K16.8 Pendent Sprinklers Only)". The sprinkler assembly with the preferred deflector 100 has been shown to satisfy each requirement of each of the FM sprinkler water distribution tests of Section 4.29, Table 4.29.1a of FM Approval Standard Class No. 2008. Distribution testing satisfying the water distribution requirements show the preferred deflector 100 can be configured for use in a suppression, and more, specifically an Early Suppression Fast Response (ESFR) sprinkler configuration. Thus, it has been shown that the arrangement of slots and tines and/or their particularized configurations define fluid deflecting surfaces and passageways of the sprinkler to distribute water to satisfy the fluid density requirements, measured in gallons per minute per square foot (GPM/SQ. FT.), under the industry accepted standards. In view of the satisfactory FM testing, it is believed that the arrangement of tines and slots define a deflector configuration that distributes a flow of water from the outlet of the sprinkler frame in a fluid density pattern that satisfies the ESFR fluid distribution requirements under Section 45, UL Standard for Early-Suppression Fast-Response Sprinklers UL 1767 (2010).

Figure 3:
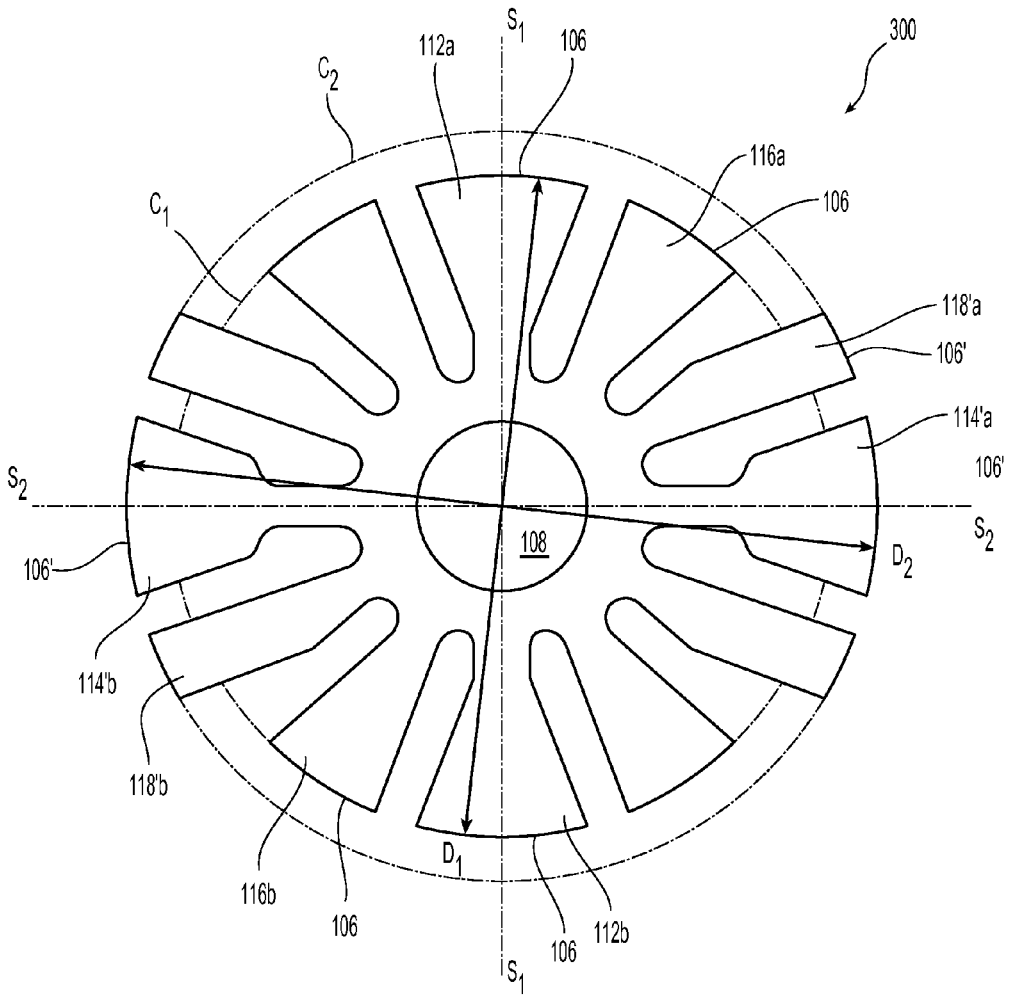
FIG. 3 is a plan view of another preferred deflector member for use in the assembly of FIG. 1.

As noted above, the deflector member 100 of FIG. 2 is substantially circular. In an alternate embodiment, for example as shown in FIG. 3, the deflector member 300 can be substantially non-circular. In one preferably exemplary embodiment of a deflector 300 can define two or more diameters such that the deflector is, for example, oblong. More specifically, the deflector 300 includes a first pair of diametrically opposed symmetrical tines 112*a*, 112*b* having peripheral edges 106 to define a first diameter D1, which preferably measures about 1¼ inch and more preferably 1.27 inch. The deflector member 300 further includes a preferred second pair of diametrically opposed symmetrical tines 114'*a*, 114'*b* having peripheral edges 106' which define a second diameter D2 that is preferably greater than D1. In one particular embodiment, the second diameter D2 is about 1.5 inches and more preferably 1.44 inches. For the deflector 300, the first and second diameters D1, D2 respectively define first concentric circle C1 and second concentric circle C2.

In another preferred aspect, the tines disposed between the first and second symmetric tines 112, 114' of the sprinkler can include peripheral edges disposed on either one of the first and second concentric circles C1, C2. For example, in the preferred deflector 300, the first asymmetric tine pair 116*a*, 116*b* include a peripheral edge 106 disposed on the first concentric circle C1. The preferred deflector 300 further preferably includes a second asymmetric tine pair 118'*a*, 118'*b* having a peripheral edge 106' disposed on the second concentric circle C2. The preferred deflector 300 can include preferred features previously described, for example, the outer edges of the tines and defining the slot sidewalls can define the angular relations previously described.

As described above, the preferred deflector embodiments described herein have demonstrated suppression type fluid distribution as defined under industry accepted fluid distribution standards. When the preferred deflector members are coupled to a sprinkler frame 12, for example, as previously described, and coupled to a water supply for fluid distribution, the sprinkler assemblies provide for a spray pattern that is preferably an umbrella shaped spray pattern. In one preferred aspect, the oblong shape of the deflector 300 in combination with the preferred sprinkler frame 12 preferably define a substantially uniform spray pattern about the sprinkler axis A-A over a range of fluid inlet pressures to the sprinkler assembly, which preferably range from about 50 psi. to 150 psi. and are more particularly any one of 50 psi., 75 psi. or 150 psi.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A sprinkler comprising:

a frame having a body having an inlet, an outlet and an internal passageway extending between the inlet and the outlet to define a longitudinal sprinkler axis, the frame including two frame arms extending distally from the body about the outlet to define a plane bisecting the body such that the arms are equidistantly disposed about the plane; and a planar fluid deflecting structure supported by the frame arms, the fluid deflecting structure having a center aligned along the longitudinal sprinkler axis and a peripheral edge about the center, the deflecting structure including a plurality of spaced apart tines defining a plurality of slots including a first pair of symmetrical tines defining a first axis of symmetry disposed in the plane;

a second pair of symmetrical tines defining a second axis of symmetry disposed orthogonally with respect to the first axis of symmetry, each pair of symmetrical tines including a first portion having a constant width and a second portion radially outward of the first portion having a variable width such that the second portion broadens in the direction from the center to the peripheral edge; and three groups of asymmetric slots angularly disposed between the first and second pairs of symmetric tines, the three groups of asymmetric slots including a first group of asymmetric slots, each slot in the first group of asymmetric slots having a first portion with a constant width and a second portion with a variable width radially outward of the first portion of the slot;

the first group of asymmetric slots being angularly disposed between a second group of asymmetric slots and a third group of asymmetric slots, each of the second and third group of asymmetric slots having first portion with a constant width and a second portion with a variable width radially inward of the first portion of the slot, each asymmetric slot in the three groups of asymmetric slots being asymmetric about an axis extending radially through the asymmetric slot and centered through the first portion of the asymmetric slot having a constant width.

2. The sprinkler of claim 1, wherein the second portion of the second symmetrical tine includes an outer edge having a first segment defining a first included angle with respect to the second axis of symmetry and a second segment defining a second included angle with respect to the second axis of symmetry that is less than the first angle.

3. The sprinkler of claim 1, wherein the outlet to the deflecting structure defines a distance of about 1¼ inch.

4. The sprinkler of claim 1, wherein the deflecting structure is substantially circular defining a diameter of about 1¼ inch.

5. The sprinkler of claim 1, wherein the deflecting structure is non-circular, the peripheral edge including a first peripheral edge defining a first diameter of the deflecting structure about the center, and a second peripheral edge defining a second diameter of the deflecting structure about the center, the second diameter being greater than the first diameter.

6. The sprinkler of claim 5, wherein the first diameter is about 1¼ inches and the second diameter is about 1.5 inches.

7. The sprinkler of claim 1, wherein the deflecting structure includes a central opening disposed about a distal terminal portion of the frame, the first portions of each of the symmetrical tines having a first end disposed between the peripheral edge and the central opening and a second end disposed between the first end and the central opening, the first end of the first portion of the second symmetrical tine being disposed at a distance from the first axis of symmetry that is greater than the distance between the first end of the first portion of the first symmetrical tine and the second axis of symmetry.

8. The sprinkler of claim 1, wherein the first asymmetrical slot includes an open end and a closed end, a pair of spaced apart sidewalls extending from the closed end to the open end, the pair of sidewalls include a first sidewall defining a first substantially constant included angle with respect to the first axis of symmetry over the first and second portions of the slot and a second sidewall having a first segment extending parallel to the first sidewall and a second segment defining a second included angle with respect to the second axis of symmetry, the second included angle being less than the first included angle.

9. The sprinkler of claim 1, wherein the second portion of each tine of the first pair of symmetrical tines includes an outer edge having a segment which extends to the peripheral edge and defines a substantially constant included angle with respect to the first axis of symmetry.

10. The sprinkler of claim 1, wherein the deflecting structure includes a first surface and an opposite second surface to define a uniform thickness over the deflecting structure, each of the first and second surfaces being perpendicular to the longitudinal sprinkler axis.

11. The sprinkler of claim 1, wherein the second portion of the first pair of symmetrical tines varies in width at one constant rate along its length, the second portion of the second pair of symmetrical tines varying in width at a first constant rate and a second constant rate different than the first constant rate over the length of the second portion of the second pair of symmetrical tines.

12. The sprinkler of claim 1, wherein the deflecting structure includes two pairs of asymmetric tines angularly disposed between the first and second pairs of symmetric tines, the two pairs of asymmetric tines being angularly adjacent to one another to define therebetween an asymmetric slot of the first group of asymmetric slots.

13. The sprinkler of claim 1, wherein each of the asymmetric slots includes an open end and a closed end defining the radially innermost portion of the slot, wherein the closed end of at least one of the second and third group of asymmetric slots is more radially inward than the closed end of the first group of asymmetric slots.

14. The sprinkler of claim 1, wherein each of the asymmetric slots includes an open end, a closed end defining the radially innermost portion of the slot, and a pair of spaced apart sidewalls extending from the closed end to the open end, wherein one sidewall of the second group of asymmetric slots is defined by an outer edge of the first pair of symmetric tines and the third group of asymmetric slots is defined by an outer edge of the second pair of symmetric tines, the pair of sidewalls of the first group of asymmetric slots includes a first sidewall defining a first substantially constant included angle with respect to the first axis of symmetry and a second sidewall having a first segment extending parallel to the first sidewall of the first group of asymmetric slots and a second segment defining a second included angle with respect to the second axis of symmetry, the second included angle being less than the first included angle.

15. The sprinkler of claim 14, wherein the first sidewall is angularly disposed closer to the first axis of symmetry than the second sidewall, the second sidewall being angularly disposed closer to the second axis of symmetry than the first sidewall.

16. The sprinkler of claim 1, wherein the peripheral edge includes a first peripheral edge defining a first diameter of a first circle about the center, and a second peripheral edge defining a second diameter of a second circle about the center, the second diameter being greater than the first diameter such that the first circle is smaller and concentric with the second circle.

17. The sprinkler of claim 16, wherein the first peripheral edge is a peripheral edge of the first pair of symmetrical tines and the second peripheral edge is a peripheral edge of the second portion of symmetrical tines.

18. The sprinkler of claim 16, further comprising a plurality of asymmetric tines angularly disposed between the first and second pairs of symmetric tines, each of the plurality of asymmetric tines having a peripheral edge on one of the first and second concentric circles.

19. The sprinkler of claim 18, wherein the plurality of asymmetric tines includes a first pair of asymmetric tines with its peripheral edge on the first circle and a second pair of asymmetric tines with its peripheral edge on the second circle.

20. The sprinkler of claim 1, wherein the sprinkler is an early suppression (ESFR) sprinkler.

21. A sprinkler comprising:

a frame having a body having an inlet, an outlet and an internal passageway extending between the inlet and the outlet to define a longitudinal sprinkler axis, the frame including two frame arms extending distally from the body about the outlet to define a plane between the frame arms with the longitudinal axis disposed in the plane; and a planar fluid deflecting structure supported by the frame arms, the fluid deflecting structure having a center aligned along the longitudinal sprinkler axis, a first peripheral edge defining a first diameter of the deflecting structure about the center, and a second peripheral edge defining a second diameter of the deflecting structure about the center, the second diameter being greater than the first diameter, the deflecting structure including a plurality of spaced apart tines defining a plurality of slots including a first pair of symmetrical tines defining a first axis of symmetry disposed in the plane;

a second pair of symmetrical tines defining a second axis of symmetry disposed orthogonally with respect to the first axis of symmetry, each pair of symmetrical tines including a first portion having a constant width and a second portion radially outward of the first portion having a variable width such that the second portion broadens in the direction from the center to the peripheral edge; and three groups of asymmetric slots angularly disposed between the first and second pairs of symmetrical tines, the three groups of asymmetric slots including a first group of asymmetric slots having a first portion with a constant width and a second portion with a variable width radially outward of the first portion of the slot, the first group being angularly disposed between a second and third group of asymmetric slots, each of the second and third group of slots having a first portion with a constant width and a second portion with a variable width radially inward of the first portion of the slot, each asymmetric slot in the three groups of asymmetric slots is asymmetric about an axis extending radially through the asymmetric slot and centered through the first portion of the asymmetric slot having a constant width.

22. The sprinkler of claim 21, wherein the second portion of the second pair of symmetrical tines includes an outer edge having a first segment defining a first included angle with respect to the second axis of symmetry and a second segment defining a second included angle with respect to the second axis of symmetry that is less than the first angle.

23. The sprinkler of claim 21, wherein each of the asymmetric slots includes an open end and a closed end defining the radially innermost portion of the slot, wherein the closed end of at least one of the second and third group of asymmetric slots is more radially inward than the closed end of the first group of asymmetric slots.

24. The sprinkler of claim 21, wherein each of the asymmetric slots includes an open end, a closed end defining the radially innermost portion of the slot, and a pair of spaced apart sidewalls extending from the closed end to the open end, wherein one sidewall of the second group of asymmetric slots is defined by an outer edge of the first pair of symmetric tines and the third group of asymmetric slots is defined by an outer edge of the second pair of symmetric tines, the pair of sidewalls of the first group of asymmetric slots includes a first sidewall defining a first substantially constant included angle with respect to the first axis of symmetry and a second sidewall having a first segment extending parallel to the first sidewall of the first group of asymmetric slots and a second segment defining a second included angle with respect to the second axis of symmetry, the second included angle being less than the first included angle.

* * * * *